US011629025B2

(12) United States Patent
Aparicio et al.

(10) Patent No.: US 11,629,025 B2
(45) Date of Patent: Apr. 18, 2023

(54) RESIDUAL FILM WINDER FOR A PACKAGING MACHINE

(71) Applicant: MULTIVAC SEPP HAGGENMUELLER SE & CO. KG, Wolfertschwenden (DE)

(72) Inventors: David Jimenez Aparicio, Pineda de Mar (ES); Michael Wolters, Nules (ES)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 133 days.

(21) Appl. No.: 17/179,966

(22) Filed: Feb. 19, 2021

(65) Prior Publication Data

US 2021/0261373 A1 Aug. 26, 2021

(30) Foreign Application Priority Data

Feb. 21, 2020 (EP) ..... 20158680

(51) Int. Cl.

| | |
|---|---|
| ***B65H 18/08*** | (2006.01) |
| ***B65H 23/025*** | (2006.01) |
| ***B65H 27/00*** | (2006.01) |
| *B65H 35/02* | (2006.01) |
| *B65H 35/04* | (2006.01) |

(52) U.S. Cl.

CPC ..... *B65H 23/0251* (2013.01); *B65H 18/08* (2013.01); *B65H 27/00* (2013.01); *B65H 35/02* (2013.01); *B65H 35/04* (2013.01); *B65H 2404/1314* (2013.01); *B65H 2701/1752* (2013.01); *B65H 2801/81* (2013.01)

(58) Field of Classification Search

CPC ..... B65H 18/08; B65H 27/00; B65H 35/02; B65H 35/04; B65H 2801/81

See application file for complete search history.

(56) References Cited

U.S. PATENT DOCUMENTS

| | | | | |
|---|---|---|---|---|
| 9,678,459 | B2 * | 6/2017 | Suzuki | G03G 15/1685 |
| 10,046,574 | B2 * | 8/2018 | Nitta | B41J 11/04 |

(Continued)

FOREIGN PATENT DOCUMENTS

| | | | |
|---|---|---|---|
| DE | 19857123 | C1 | 5/2000 |
| DE | 102008033349 | A1 | 2/2010 |

(Continued)

OTHER PUBLICATIONS

European Search Report dated Sep. 7, 2020, Application No. 20158680.7-1017, Applicant Multivas Sepp Haggenmueller SE & Co. KG, 6 Pages.

*Primary Examiner* — Sang K Kim
(74) *Attorney, Agent, or Firm* — Brooks Kushman P.C.

(57) ABSTRACT

The present disclosure relates to a residual film winder for a packaging machine, wherein the residual film winder comprises a reception mandrel, a reception sleeve, and at least one film spreader. The reception sleeve is configured to be arranged onto the reception mandrel. The film spreader has a first end and a second end, wherein the first end extends out of the reception sleeve, and the first end has an outer contour extending along its long axis. The outer contour of the film spreader has at least two sections, a first section and a second section, wherein the first and second sections are not parallel to each other.

20 Claims, 5 Drawing Sheets

(56) References Cited

U.S. PATENT DOCUMENTS

| | | | |
|---|---|---|---|
| 2007/0278342 | A1 | 12/2007 | Harkins |
| 2015/0166290 | A1 | 6/2015 | Piatt et al. |
| 2017/0253459 | A1 | 9/2017 | Gabler |

FOREIGN PATENT DOCUMENTS

| | | | |
|---|---|---|---|
| EP | 2998258 | A1 | 3/2016 |
| WO | 02/092293 | A1 | 11/2002 |

* cited by examiner

RESIDUAL FILM WINDER FOR A PACKAGING MACHINE

CROSS-REFERENCE TO RELATED APPLICATIONS

This application claims foreign priority benefits under 35 U.S.C. § 119(a)-(d) to European patent application number EP 20158680.7, filed Feb. 21, 2020, which is incorporated by reference in its entirety.

TECHNICAL FIELD

The present disclosure relates to a residual film winder for a packaging machine, wherein the residual film winder comprises a reception mandrel, a reception sleeve, and at least one film spreader, wherein the reception sleeve is configured to be arranged onto the reception mandrel, wherein the film spreader has a first end and a second end, wherein the first end extends out of the reception sleeve, wherein the first end has an outer contour extending along its long axis.

BACKGROUND

Tray sealing machines usually comprise a feed belt, a sealing station, a film tensioning device, and a residual film winder. During operation, tray-shaped packages are sealed with the film and air-tight packages are produced. The remaining cut-off residual film is wound up in the form of what is known as a residual film grid using the residual film winder to form a roll.

A reception sleeve that may be mounted on a mandrel of a packaging machine for winding up a film used in the packaging process on the reception sleeve is known from US 2017/0253459 A1. The document DE 10 2008 033 349 A1 discloses a film winding device with a shaft, a tube and at least one foldable plate connected to the tube. The document EP 2 998 258 A1 discloses a film winding device for a packaging machine with paddles, which are configured to wind up a film on their outside.

With conventional paddles, the edge trims of the residual film grid tends to concentrate on the center part of the rewinder shaft. This results in a loosening of the film tension in the sealing zone, which may cause a loss of sealing quality and even wrinkles in the package.

SUMMARY

The present disclosure has an object of providing a residual film winder, which allows an improved packaging quality.

The disclosure provides a residual film winder for a packaging machine, wherein the residual film winder comprises a reception mandrel, a reception sleeve, and at least one film spreader, wherein the reception sleeve is configured to be arranged onto the reception mandrel, wherein the film spreader has a first end and a second end, wherein the first end extends out of the reception sleeve, wherein the first end has an outer contour extending along its long axis, wherein the outer contour of the film spreader has at least two sections, a first and a second section, wherein the first and second section are not parallel to each other.

This geometry improves the rewinding of the edge trims of the residual film by distributing it along the residual film winder.

The first and second sections of the outer contour of the film spreader may be inclined with respect to each other. This will facilitate improvement of the rewinding of the edge trims of the residual film by distributing it along the residual film winder.

In one embodiment, the inclination angle between the first and second sections is between 130° and 178°, preferably between 160° and 178°. These rather large inclination angles facilitate forming a smooth tip on the outer contour of the film spreader and preventing damage on the residual film typically consisting of plastic material.

In one embodiment, the first and second sections of the outer contour of the film spreader merge at least approximately at the center of the outer contour. Thus, at the center of the outer contour a peak will be formed, which will prevent the edge trims of the residual film from climbing over it and concentrating on the central part of the residual film winder.

In an embodiment, an outermost point or region of the film spreader projecting out of the reception sleeve is at least approximately at the center of the outer contour. Thus, at the center of the outer contour a peak will be formed, which will prevent the edge trims of the residual film from concentrating on the central part of the residual film winder.

In an alternative embodiment, the outer contour of the film spreader has four sections, wherein the first and second section are inclined with respect to each other, wherein a third and fourth section are inclined with respect to each other. This geometry provides two peaks, which may prevent the edge trims of the residual film from concentrating on the central part of the residual film winder.

The inclination angle between the first and second section, and the inclination angle between the third and fourth section may range between 100° to 130°. These rather large inclination angles facilitate forming a smooth tip on the outer contour of the film spreader and preventing damage on the residual film consisting of plastic material.

It is advisable to provide at least one bracket at the second end of the film spreader, wherein the bracket extends into the reception sleeve through a recess provided at the reception sleeve. Thus, the film spreader and the reception sleeve can be easily mounted together.

In one embodiment, two or more brackets are provided at the first end of the film spreader, wherein two or more recesses are provided at the reception sleeve. Thus, the film spreader and the reception sleeve can be more securely mounted together.

In another aspect, the disclosure provides a residual film winder for a packaging machine, wherein the residual film winder comprises a reception mandrel, a reception sleeve, and at least one film spreader, wherein the reception sleeve is configured to be arranged onto the reception mandrel, wherein the film spreader has a first end and a second end, wherein the first end extends out of the reception sleeve, wherein the first end has an outer contour extending along its long axis, wherein at least three film spreaders are provided in a row and/or being spaced apart from each other, wherein the film spreader provided in the middle extends further outwards beyond the surface of the reception sleeve in comparison to the film spreaders provided on the right and left hand side.

BRIEF DESCRIPTION OF THE DRAWINGS

The disclosure will now be further explained with reference to an exemplary embodiment as shown in the figures.

In one embodiment, the outer contour of the film spreader is rounded, i.e., has one or more rounded peaks.

In one embodiment, the crossing spot of the two sections of the outer contour of the film spreader is rounded, i.e., has one or more rounded peaks so that the residual film is not damaged, which can deteriorate packaging quality.

Figure 1:
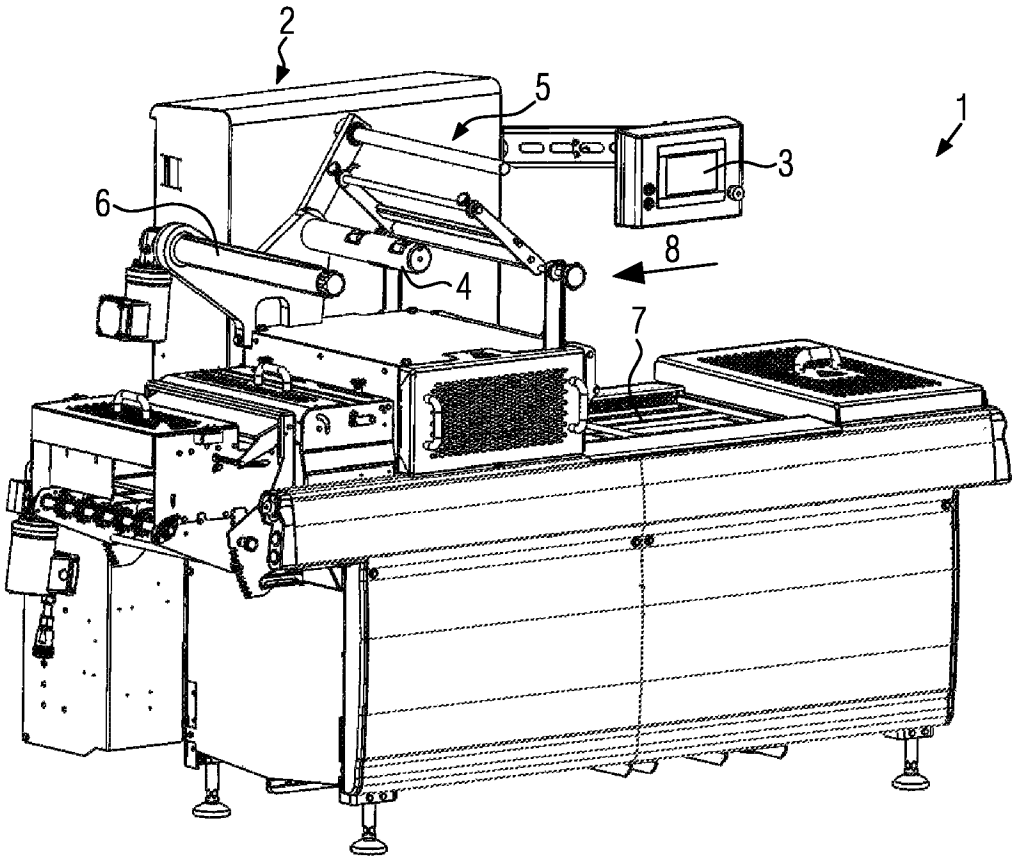
Figure 2:
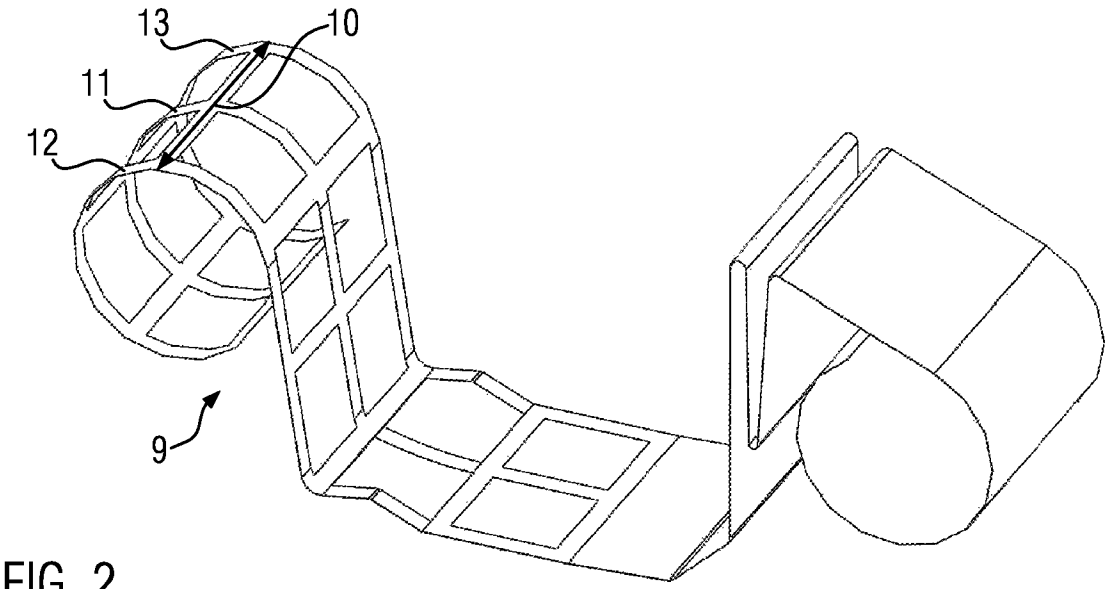
Figure 3:
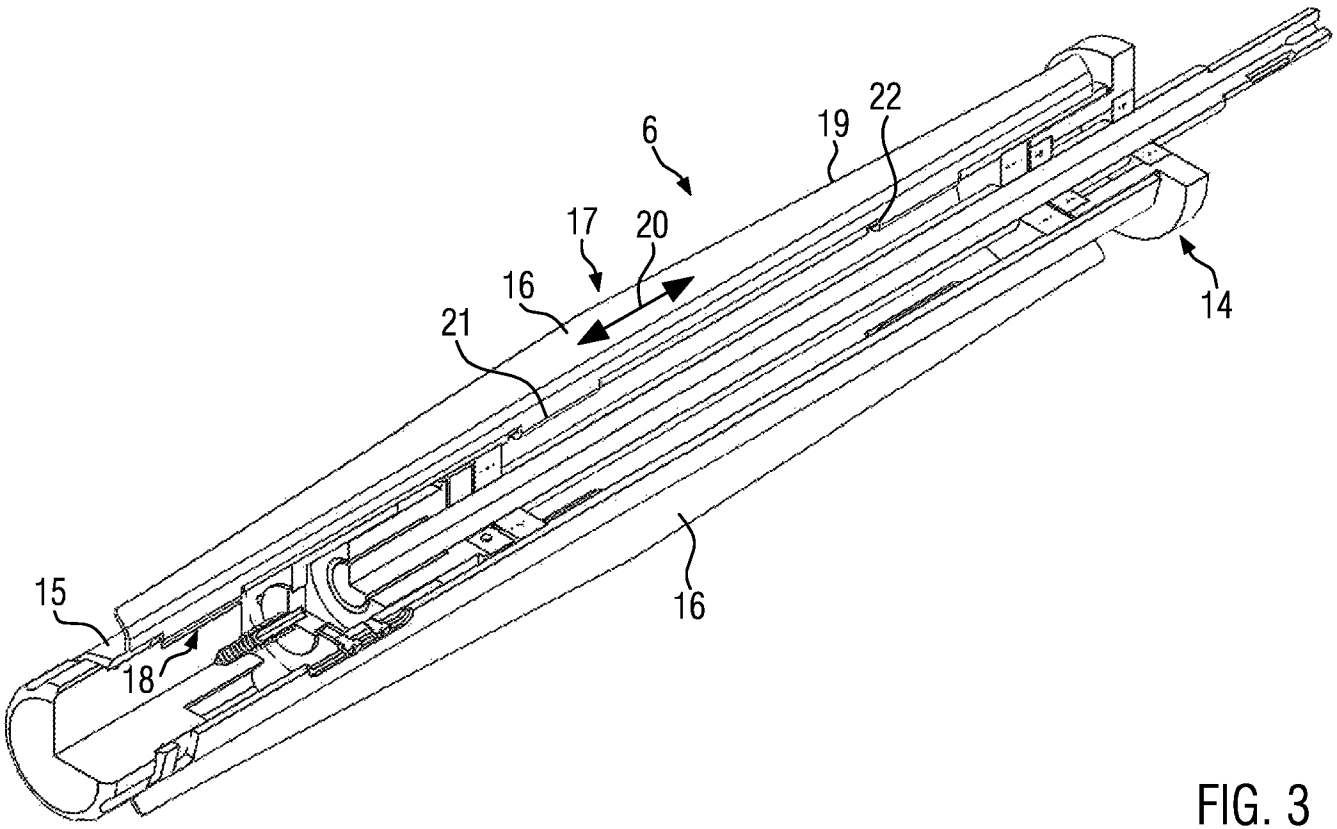
Figure 4:
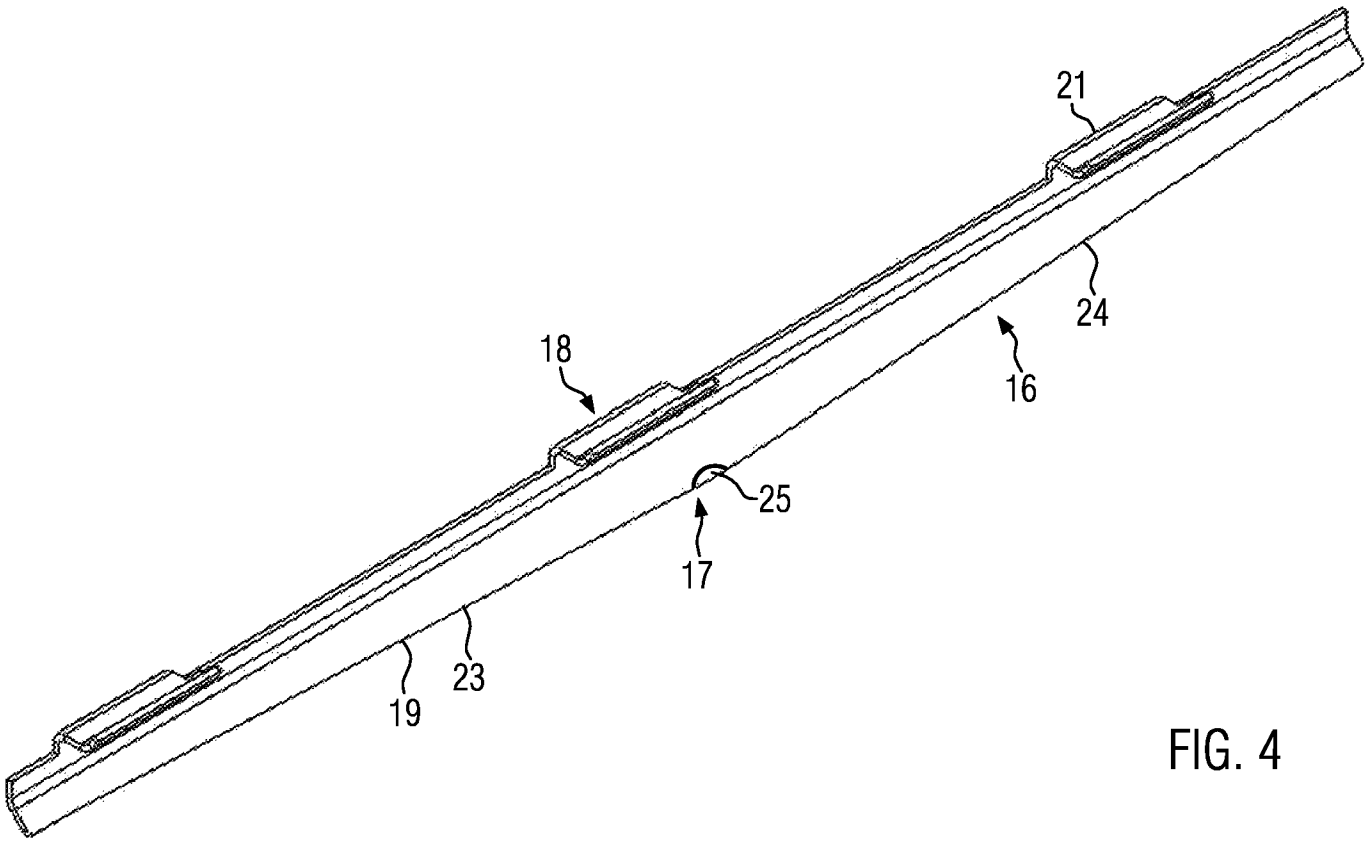
Figure 5:
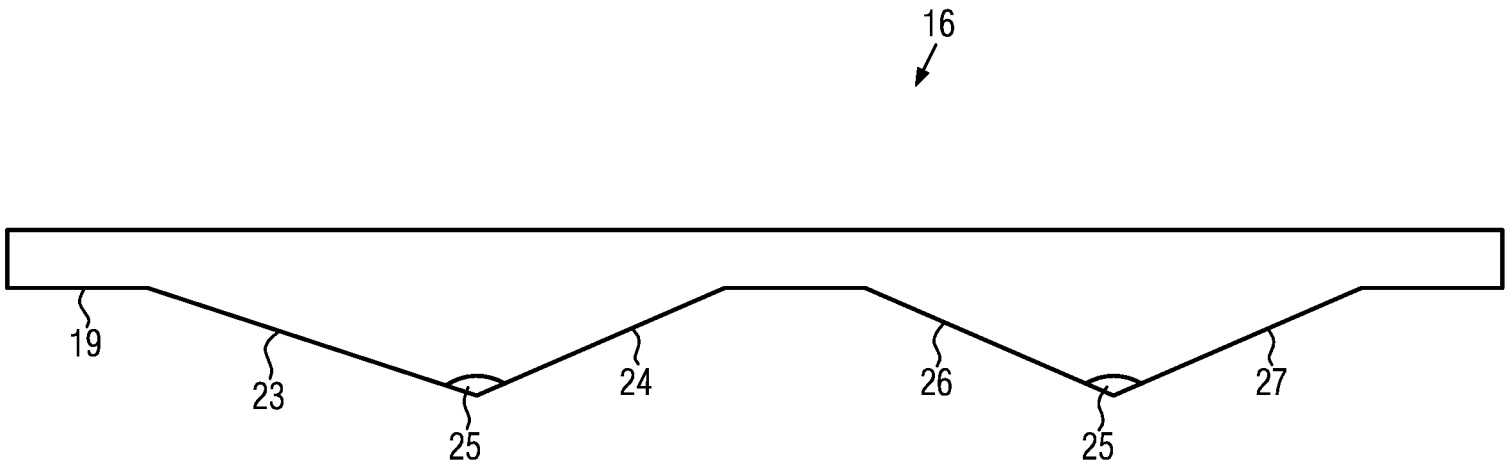

FIG. 1 shows a schematic perspective view of a packaging machine;

FIG. 2 shows a perspective view of an example of a residual film grid;

FIG. 3 shows a perspective and sectional view of a residual film winder;

FIG. 4 shows a perspective view of a film spreader according to the disclosure; and FIG. 5 shows a perspective view of a film spreader according to the disclosure.

DETAILED DESCRIPTION

FIG. 1 shows a packaging machine 1 in the form of a tray sealing machine. The packaging machine 1 comprises a sealing station 2, an operating device 3, a film supply roll 4 for unrolling a cover film, a film tensioning device 5 and a residual film winder 6. The packaging machine 1 has a plurality of tracks, which can be adapted to different tray (package) dimensions by means of adjustable interbars 7.

During operation, trays (not shown) are moved in a production direction 8 by means of a feed system into the sealing station 2. The sealing station 2 closes after the feed movement such that it forms a chamber around the trays. A cover film is supplied by the film supply roll 4 and passed through the film tensioning device 5. In the sealing station 2, the trays are sealed with the film and air-tight packages are produced. The remaining cut-off residual film is wound up using the residual film winder 6 to form a roll of the residual film.

FIG. 2 shows an example of a remaining cut-off residual film in the form of a residual film grid 9. The residual film grid 9 shown in FIG. 2 has three longitudinal strips along its width 10, a middle strip 11, and two lateral strips 12, 13.

FIG. 3 shows a perspective and sectional view of the residual film winder 6. The residual film winder 6 comprises of a reception mandrel 14, a reception sleeve 15 and two residual film spreaders 16. The reception sleeve 15 is configured to be arranged onto the reception mandrel 14.

The film spreader 16 is configured here as a flap or a paddle. The film spreader 16 has a first end 17 and a second end 18. The first end 17 extends out of the reception sleeve 15 and has an outer contour 19 extending along its long axis 20. At the second end 18 of the film spreader 16 a plurality of brackets 21 are provided. The brackets 21 extend rather short distances into the reception sleeve 15 through recesses 22 provided at the reception sleeve 15. The brackets 21 are shaped such that the film spreaders 16 cannot fall out of the reception sleeve 10 during operation.

FIG. 4 shows a perspective view of the film spreader 16 according to the disclosure. The outer contour 19 of the film spreader 16 has two sections, a first section 23 and a second section 24. As can be seen in FIG. 4, the first 23 and second 24 sections are inclined with respect to each other with an inclination angle 25 of around 170°. This angle may vary from 130° to 178° in other embodiments of the disclosure. The inclination angles are chosen such that, e.g., the lateral strips 12 and 13 of a residual film grid 9 do not tend to slide into the center of the film spreader 16 during the packaging operation, when the residual film grid 9 is wound up on the residual film winder 6, due to the peak created in the vicinity of the center of the film spreader 16.

In FIG. 5 another embodiment of the film spreader 16 is shown. Here, the outer contour 19 of the film spreader 16 has at least four sections including, a first 23 and a second section 24. The first 23 and second 24 sections are inclined with respect to each other with an inclination angle 25 of around 120°. Third 26 and fourth 27 sections are inclined with respect to each other with an inclination angle 25 of around 120°. In this embodiment, the inclinations between the first and second sections 23 and 24 and between the third and fourth sections 26 and 27 of the film spreader 16, respectively, are designed to avoid a sliding of, e.g., lateral strips 12 and 13 of a residual film grid 9 into the center of the film spreader 16.

What is claimed is:

1. A residual film winder for a packaging machine, the residual film winder comprising:

a reception mandrel;

a reception sleeve configured to be arranged onto the reception mandrel; and a film spreader having a first end and a second end, wherein the first end extends out of the reception sleeve, and the first end has an outer contour extending along its long axis, wherein the outer contour of the film spreader has a first section and a second section, wherein the first and second sections are not parallel to each other.

2. The residual film winder according to claim 1, wherein the first and second sections of the outer contour of the film spreader are inclined with respect to each other.

3. The residual film winder according to claim 2, wherein an inclination angle between the first and second sections is between 130° and 178°.

4. The residual film winder according to claim 3, wherein the inclination angle between the first and second sections is between 160° and 178°.

5. The residual film winder according to claim 3, wherein the first and second sections of the outer contour of the film spreader merge at least approximately at a center of the outer contour.

6. The residual film winder according to claim 1, wherein the first and second sections of the outer contour of the film spreader merge at least approximately at a center of the outer contour.

7. The residual film winder according to claim 6, wherein an outermost point or region of the film spreader extending out of the reception sleeve is at least approximately at the center of the outer contour.

8. The residual film winder according to claim 1, wherein an outermost point or region of the film spreader extending out of the reception sleeve is approximately at a center of the outer contour.

9. The residual film winder according to claim 1, wherein the outer contour of the film spreader further comprises a third section and a fourth section, wherein the first and second sections are inclined with respect to each other, and the third and fourth sections are inclined with respect to each other.

10. The residual film winder according to claim 9, wherein an inclination angle between the first and second sections, and an inclination angle between the third and fourth sections each range between 100° to 130°.

11. The residual film winder according to claim 10, further comprising one or more additional film spreaders provided along a circumferential direction of the reception sleeve.

12. The residual film winder according to claim 1, further comprising one or more additional film spreaders provided along a circumferential direction of the reception sleeve.

13. The residual film winder according to claim 1, wherein at the second end of the film spreader at least one bracket is provided, and wherein each of the at least one bracket extends into the reception sleeve through a recess provided at the reception sleeve.

14. The residual film winder according to claim 13, wherein the at least one bracket comprises two or more brackets provided at the second end of the film spreader, and wherein two or more recesses are provided at the reception sleeve.

15. The residual film winder according to claim 1, wherein the outer contour of the film spreader is rounded.

16. The residual film winder according to claim 1, wherein a crossing spot of the first and second sections of the outer contour of the film spreader is rounded.

17. A residual film winder for a packaging machine, the residual film winder comprising:

a reception mandrel;

a reception sleeve arranged on the reception mandrel; and first and second film spreaders attached to the reception sleeve so that the film spreaders are spaced apart from each other in a circumferential direction with respect to the reception sleeve, each film spreader having a first end and a second end, wherein the first end of each film spreader extends away from the reception sleeve and has an outer contour extending along a longitudinal axis of the first end, and wherein the outer contour of each film spreader has a first section and a second section, and the first and second sections are inclined with respect to each other.

18. The residual film winder according to claim 17, wherein the outer contour of each film spreader further comprises a third section and a fourth section that are inclined with respect to each other.

19. The residual film winder according to claim 17, wherein at the second end of each film spreader at least one bracket is provided, and wherein each of the at least one bracket extends into the reception sleeve through a recess provided at the reception sleeve.

20. The residual film winder according to claim 19, wherein, for each film spreader, the at least one bracket comprises two or more brackets, and wherein two or more recesses are provided at the reception sleeve for each film spreader.

* * * * *